United States Patent [19]

Lambert

[11] 4,141,485

[45] Feb. 27, 1979

[54] SLIDE TOP CARTON

[75] Inventor: Herbert L. Lambert, Manchester, Mo.

[73] Assignee: Champion International Corporation, Stamford, Conn.

[21] Appl. No.: 868,867

[22] Filed: Jan. 12, 1978

[51] Int. Cl.[2] ..... B67D 3/00; B65D 5/72

[52] U.S. Cl. ..... 229/17 SC; 222/529

[58] Field of Search ..... 229/7 SC; 206/622; 220/257, 258, 254; 222/529, 561

[56] References Cited

U.S. PATENT DOCUMENTS

| | | | |
|---|---|---|---|
| 1,951,274 | 3/1934 | Denman | 229/7 SC |
| 2,419,182 | 4/1947 | Wells | 229/7 SC |
| 3,033,436 | 5/1962 | Peimer | 229/17 SC |
| 3,040,953 | 6/1962 | Tindall | 229/17 SC |
| 3,819,093 | 6/1974 | Forbes | 229/17 SC X |

FOREIGN PATENT DOCUMENTS 957512 5/1964 United Kingdom.

*Primary Examiner*—Davis T. Moorhead
*Attorney, Agent, or Firm*—Evelyn M. Sommer

[57] ABSTRACT

An improved slide top carton, and a one-piece blank for forming it, for dispensing products through a face therein having inner and outer overlapping members closing said face, said members having communicating orifices for dispensing the carton contents therethrough, blocking means movably attached to said carton and interposed between said inner and outer members for controlling communication between said orifices, and sealing means removably attached to at least one of said overlapping members to block communication between the orifices without regard to the position of the blocking means.

8 Claims, 4 Drawing Figures

SLIDE TOP CARTON

BACKGROUND OF THE INVENTION

The type of container designated as the slide top carton is well-known in the art. It is used for dispensing products through a face thereof on a selective basis. The face comprises outer and inner overlapping members each of which has an orifice therein and the orifices are so aligned that when in registry they form a passage such that the product within the carton can pass through the orifices to the user. Blocking means are movably attached to the carton for slideable movement between the two overlapping members. When product within the carton is desired, the blocking means can be so positioned as to allow communication of the orifices which exposes the interior of the carton, and thus, the contents therein may be dispersed. However, when access to the interior of the carton is no longer needed, the blocking means is then positioned between the two overlapping members to prevent communication between the orifices to completely block any access to the interior of the carton.

This type of carton is in wide demand and its uses are well-known as with the candy industry. However, there are certain disadvantages inherent in this container with attendant problems. One of the problems occurs during shipment of such cartons filled with product. Often, the normal jostling, vibrations, and the like, encountered by the cartons during handling and shipment cause the blocking member, which is in its closed position blocking access to the interior of the carton, to slide a sufficient distance to allow the contents or a part thereof to be unintentionally dispensed and therefore lost during shipment. This can result in significant unit product loss which, when multiplied by millions of cartons of product, can result in a significant economic disadvantage. Another problem associated with this carton is vandalism. While the carton is on retail display, vandals can simply slip the blocking means back, tamper with or pour out part or all of the contents of the carton, position the blocking means back in its original closed position and no one can determine that the carton has been tampered with until the carton is opened by the purchaser. There is no practical way to determine whether or not the displayed cartons have been tampered with and the contents partially or totally used by vandals without inspecting the contents of each carton individually.

Efforts to overcome these problems have not been successful either because, in the main, they greatly increase the cost of the carton or they detract from the convenience of using the carton. Thus, for example, use of a plastic outer wrap over the carton or use of an adhesive tape over the orifices is costly in terms of material and additional equipment and processing costs to apply the overwrap or tape to the carton.

SUMMARY OF THE INVENTION

The present invention avoids the disadvantages of the prior art by providing an improved slide top carton whose contents cannot be lost accidentally during shipment or removed prior to purchase by the consumer without detection.

Briefly stated, the present invention comprises a slide top carton, and a one-piece blank for forming it, for dispensing products through a face thereof, comprising inner and outer overlapping members closing said face, said members having communicating orifices for dispensing the carton contents therethrough, blocking means movably attached to said carton and positioned between said inner and outer overlapping member for controlling communication between said orifices, and sealing means removably attached to at least one of said overlapping members to block communication between the orifices without regard to the position of the blocking means.

BRIEF DESCRIPTION OF THE DRAWINGS

The above, as well as other objects, features, and advantages of the present invention shall become readily apparent upon reading a detailed description of a preferred embodiment thereof when viewed in conjunction with the accompanying drawings, wherein like referenced numerals indicate like structure throughout the several views showing the novel carton.

DETAILED DESCRIPTION

Figure 1:
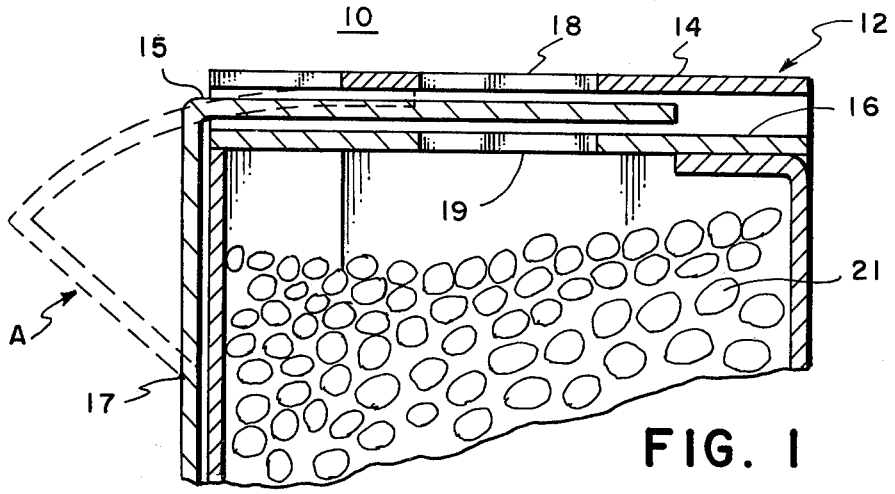
FIG. 1 PRIOR ART
FIG. 1 is a partial cross-sectional view of the slide top carton of the prior art illustrating the manner in which the orifices in the overlapping members are selectively opened or closed by the sliding member.

Referring now to the drawings, and in particular, to FIG. 1, there is depicted a partial cross-sectional view of a slide top carton 10 of the prior art wherein a slideable member selectively allows opening or closing of orifices communicating with the interior of the carton. The slide top carton itself is generally designated by reference numeral 10 with reference numeral 12 generally indicating the top of the carton or at least that face of the carton through which the contents are to be disposed. It will be realized that the carton in FIG. 1 is shown purely for illustrative purposes and is shown in an exploded view. In actual practice, the elements shown are immediately adjacent each other and do not leave space between them as shown in FIG. 1. Outer member 14 is attached by a fold or score line in a manner not shown but well-known in the art to one side of the carton and inner member 16 is attached to the other side of the carton by a fold or score line in a manner not shown but well-known in the art in such a manner that the two members are in an overlapped relationship when the carton is closed. Outer member 14 has within it orifice 18 and inner member 16 has within it orifice 19. Orifices 18 and 19 are in alignment with each other, but are separated by blocking means 15 which prevents product 21 stored within carton 10 from passing through orifice 19 to orifice 18 and thus outside the carton. It will be noted, however, that means 15 is a sliding member pivoted at fold or score line 17 and manually movable to a position A as shown by the dashed lines thus removing the barrier between orifices 18 and 19 and allowing product 21 to pass through orifices 18 and 19 to the outside of the carton. Thus, sliding member 15 allows selective communication between orifices 18 and 19 and either closes the carton to prevent removal of the product therein or opens the carton to allow removal of the product therein.

It can be readily seen that if, during shipment of the product, sliding member 15 is vibrated so as to move it to position A as shown by dashed lines, the contents of the package or the carton can pass through orifices 18 and 19 and be lost. Further, it can be seen that if vandals were to slip the package from its display rack, they could quickly move sliding member 15 to position A to open the package or carton and remove some or all of the contents thereof or otherwise tamper with the contents. It can also be seen that when the sliding member 15 is returned to its position which closes the package or carton, there is no way to determine whether or not the contents of the package have been removed without a physical inspection of the interior of the carton.

Figure 2:
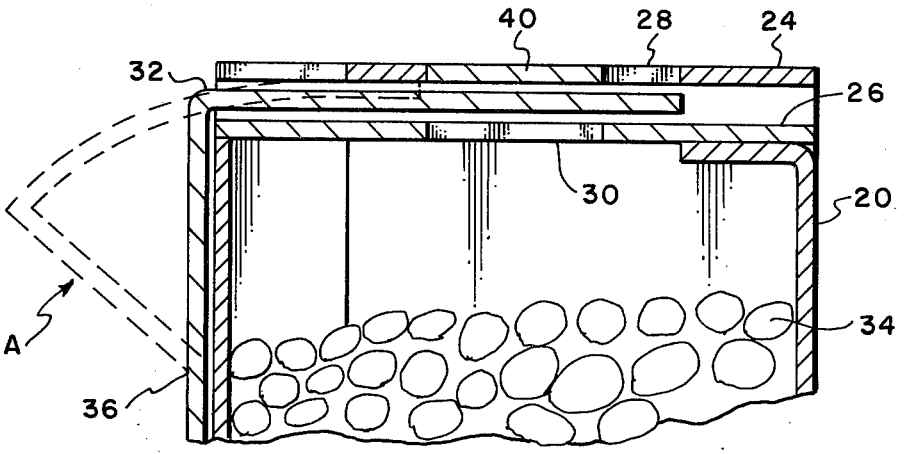
FIG. 2 is a partial cross-sectional view of a slide top carton embodying the novel improvement of the present invention, illustrating how the present invention prevents removal of the contents of the carton, even when the sliding member is removed from between the two orifices.

FIG. 2 is a partial cross-sectional view of a slide top carton embodying the novel invention which obviates the disadvantages of the prior art as explained earlier. In FIG. 2, carton 20 again has an outer member 24 and an inner member 26 which are overlapping each other to form the top of the carton. Inner member 26 has an orifice 30 and outer member 24 has an orifice 28 which is partially covered by a tab 40 removably attached thereto, as by perforations 42 shown in FIG. 3. Orifice 28 is slightly larger than orifice 30 to allow tab 40 to completely cover orifice 30 and yet allow room for the fingernail or other sharp object to be inserted at indentation 28 to remove tab 40 when necessary or desired. When it is desired to remove the contents of the package or carton 20, tab 40 is removed using the thumb and forefinger or other sharp object and sliding member 32 is moved to position A, thus coupling orifice 30 with orifice 28. It will be seen that until tab 40 is removed from carton 20, even though sliding member 32 is moved to position A manually or accidentally, the contents of the package or carton 20 cannot be removed. Further, if a vandal, seeing the product for sale, attempts to tamper with or remove product 34 from the carton 20 by moving slideable member 32 to position A, the product 34 will still be contained in carton 20 by tab 40, and the only way that the vandal can remove or reach the product will be to tear off tab 40. This means that it is easy to see when a carton has had products removed from it or to spot a carton with which there has been tampering because the removal of tab 40 is easily detected. If the tab 40 is of a different color than the remainder of the carton, its removal is even more easily visually detected.

Figure 3:
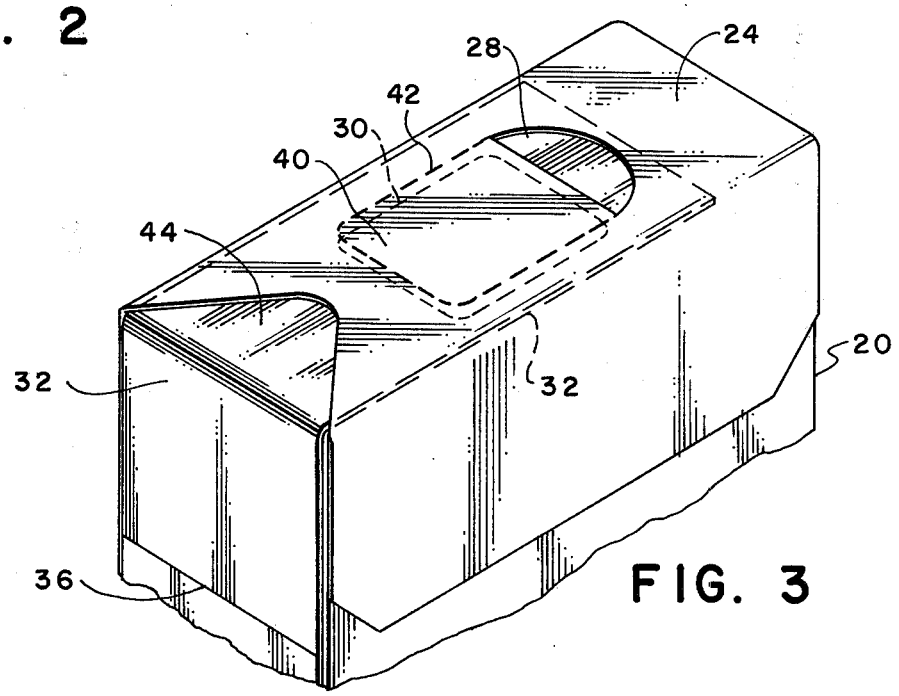
FIG. 3 is an isometric view of a slide top carton embodying the improvement of the present invention.

FIG. 3 is a partial isometric view of the novel carton 20 in its closed position with tab 40 in place and sliding member 32 in its closed position. Tab 40 is removably attached to outer member 24 by means of perforations 42 and can be easily removed by inserting the thumbnail of fingernail or other similar device in that part of orifice 28 which is not covered by the tab and simply tearing it out. Immediately under tab 40 is slideable member 32 and under slideable member 32 is inner member 26 having orifice 30 so aligned with orifice 28 that when tab 40 is removed and slideable member 32 is moved to position A as shown in FIG. 2, orifice 30 and orifice 28 are in communication with each other thus allowing the contents of the package to be removed.

To facilitate movement of slideable member 32, a portion of outer member 24 is removed to expose the top portion 44 of slideable member 32 whereby the thumb or finger may be placed on that portion 44 and the slideable member moved back and forth to selectively cover and uncover orifice 30 after tab 40 has been removed.

While not as suitable, it is evident that tab 40 may be located on inner member 26 and its removal effected by first moving sliding member 32 to position A to obtain access to tab 40. In certain instances it may be considered expedient to provide tabs for both inner member 26 and outer member 24. Further, the novel arrangement of overlapping panels with the blocking means interposed therebetween could also be provided at the bottom of the carton or also be a part of any other face of the carton.

The type of material to be used in manufacturing this carton is not critical so long as it has sufficient rigidity to form a carton of substantially rectangular cross-section and yet has sufficient resiliency that the sliding member can pivot about a fold or score line as it moves from a first to a second position to allow selective dispensing or removal of the contents of the carton. Conventional carton stock is preferred.

Figure 4:
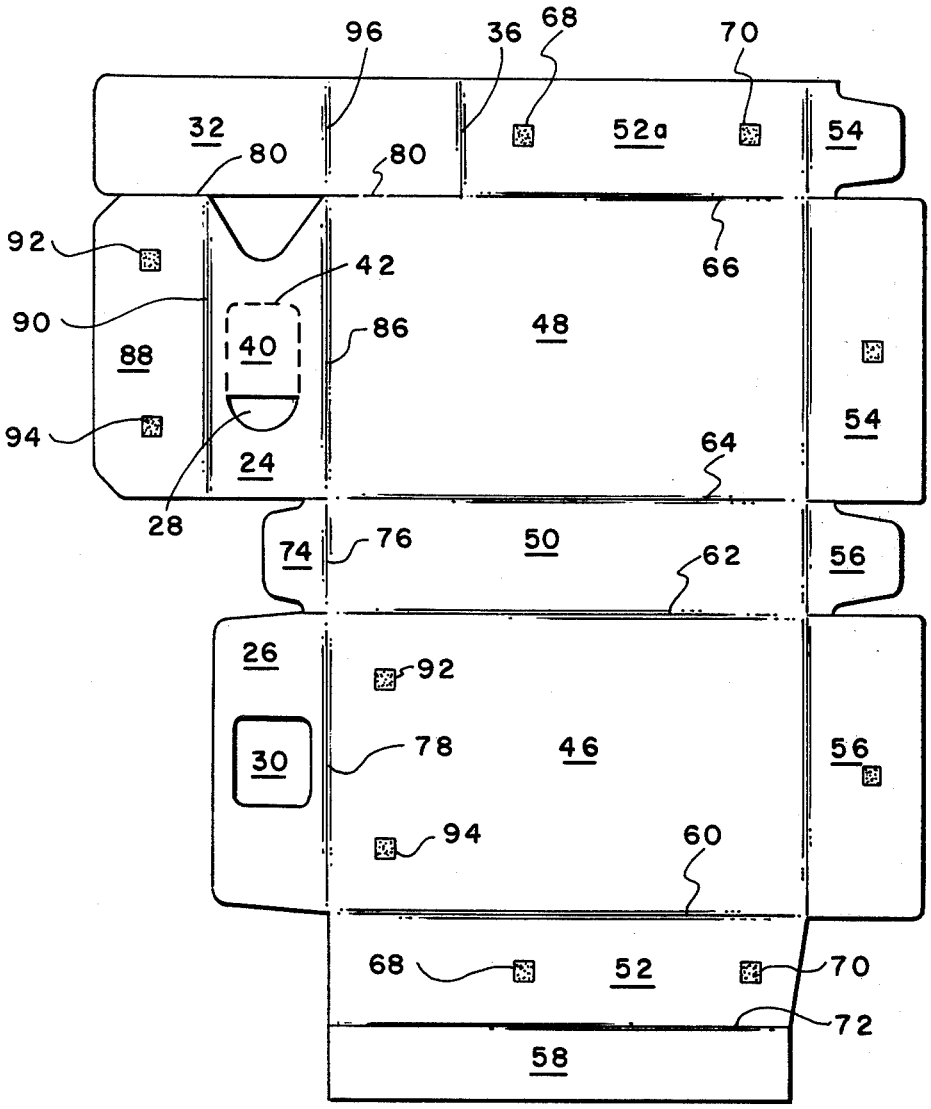
FIG. 4 is a plan view of a blank used for making the carton.

The carton shown in FIGS. 1 to 3 is made from the blank shown in FIG. 4 which comprises front and back wall panels 46 and 48, side wall panels 50 and 52 and bottom panels 54 and 56. These portions are delimited from one another by score lines or folds. In certain places the portions are separated by slits, cut lines or perforations.

To make the carton, front and back panels 46 and 48, respectively, are folded about score lines 62 and 64 so that the front and back panels 46 and 48 are parallel. Side walls 52 and **52*a* are then folded about score lines 60 and 66 such that side wall 52 is under side wall 52*a* and the two are glued together as shown by glue spots at 68 and 70. Link 58 is folded along score lines 72 and rests against and parallel to back wall 48. Thus side wall 52 and link 58 when folded about score line 72 form a 90° corner of the box which prevents any of the contents from escaping when sliding member 32 is pulled back and pivoted about score line 36. Bottom tabs and flaps 54 and 56 are then folded and glued. The carton is now entirely folded except for the top. Flap 72 of the top portion is first folded inwardly along score line 76. Inner member 26 having orifice 30 therein is then folded inwardly about score line 78. Sliding or blocking member 32, which, is separated from the remainder of the carton by slit and perforations 80 and score line 36 is then folded inwardly about score line 96 so that it overlaps inner member 26 and covers orifice 30. The last member to be considered is outer member 24 having tab 40 held therein by means of perforations 42 is folded inwardly about score line 86 to cover slideable member 32. To complete construction of the carton, web portion 88 is folded about score line 90 and glued at points 92 and 94 against front wall 46**.

While the invention has been described in connection with the foregoing embodiment, it is not intended to limit the invention to the particular form set forth above, but, on the contrary, it is intended to cover such alternatives, modifications, and equivalents as may be included within the spirit and scope of this invention as defined by the appended claims.

What is claimed is:

1. A slide top carton comprising:

a sidewall structure including first, second and third relatively narrow, generally rectangular panels alternating with first and second relatively wider, generally rectangular panels;

a generally rectangular inner member extending from and substantially as wide as one of said wider panels, said inner member having an orifice therethrough;

a generally rectangular outer member extending from and substantially as wide as the other of said wider panels, said outer member being positioned in overlapping relation to said inner member and having an orifice area aligned with the orifice of said inner member, the orifice area of said outer member initially being sealed by a removable sealing means; and a sliding member forming an extension of one of said narrow panels, said sliding member being substantially as wide as the panel from which it extends and including a portion slidably positioned between said overlapping inner and outer members to control communication between the orifices therein.

2. A slide top carton as defined in claim 1 wherein said removable sealing means comprises a tab defined at least in part by perforations in the material of said outer member.

3. A slide top carton as defined in claim 2 wherein said outer member includes an aperture therethrough at one edge of said tab, said aperture permitting a fingernail or thin implement to be inserted between the tab and the surface of said sliding member to facilitate removal of the tab.

4. A slide top carton as defined in claim 3 wherein said outer member includes a generally rectangular web portion which overlies and is secured to the surface of said one wider panel.

5. A one piece blank for a slide top carton comprising:

a sidewall structure including first, second and third relatively narrow, generally rectangular panels alternating with first and second relatively wider, generally rectangular panels, said panels being bounded by parallel fold lines;

a generally rectangular inner member extending from and substantially as wide as one of said wider panels, said inner member having an orifice therethrough;

a generally rectangular outer member extending from and substantially as wide as the other of said wider panels, said outer member having an orifice area initially sealed by a removable sealing means; and a sliding member forming an extension of one of said narrow panels, said sliding member being substantially as wide as the panel from which it extends.

6. A one piece blank as defined in claim 5 wherein said removable sealing means comprises a tab defined at least in part by perforations in the material of said outer member.

7. A one piece blank as defined in claim 6 wherein said outer member includes an aperture therethrough at one edge of said tab.

8. A one piece blank as defined in claim 7 wherein said outer member includes a generally rectangular web portion which is adapted to be secured to the surface of said one wider panel in the erected carton.

* * * * *